United States Patent [19]

Quinn

[11] 3,975,071

[45] Aug. 17, 1976

[54] FILE CABINET CONSTRUCTION

[75] Inventor: David A. Quinn, Brooklyn, N.Y.

[73] Assignee: Supreme Equipment & Systems Corporation, Brooklyn, N.Y.

[22] Filed: Oct. 22, 1974

[21] Appl. No.: 516,847

[52] U.S. Cl. ..... 312/323; 108/143; 312/319

[51] Int. Cl.[2] ..... A47B 88/06

[58] Field of Search ..... 312/322, 323, 319, 330, 312/334; 108/143, 138, 5

[56] References Cited

UNITED STATES PATENTS

| | | | |
|---|---|---|---|
| 487,150 | 11/1892 | Ohmer | 312/323 |
| 888,512 | 5/1908 | Kurz | 312/323 |
| 1,975,327 | 10/1934 | Loney | 312/323 |
| 2,357,668 | 9/1944 | Laham | 108/143 |
| 3,814,366 | 6/1974 | Staifer | 312/323 |

*Primary Examiner*—Paul R. Gilliam
*Assistant Examiner*—Kenneth J. Dorner
*Attorney, Agent, or Firm*—Arthur M. Lieberman; Francis J. Murphy

[57] ABSTRACT

A file cabinet construction includes at least one shelf mounted within a housing having parellel opposed side walls and a rear wall. A number of guide rails are mounted at predetermined positions along the shelf so that they are parallel to the side walls of the housing. Each guide rail has a longitudinal slot extending into the guide rail from the end located nearest to the rear wall of the housing and terminating at a point adjacent to the forward edge of the shelf. A boxlike container which includes opposed parallel longitudinal sides and a bottom having a longitudinal channel is detachably mounted on each guide by a floating pin. The floating pin is mounted so that the longitudinal axis of the pin is transverse to the channel in the bottom of each container. The channel is configured so that it fits over the guide rail and the floating pin is arranged so that it will slide into the longitudinal slot in the guide rail as the container slides outwardly from the rear wall of the housing, thereby attaching the container to the shelf.

19 Claims, 13 Drawing Figures

FILE CABINET CONSTRUCTION

BACKGROUND

This invention relates to a file cabinet construction and, more particularly, to such a construction including one or more shelves on which a number of boxlike containers are slidably mounted.

Known file cabinets include a plurality of relatively wide drawers which are mounted in tiers in a superimposed relationship. These drawers are mounted within a file cabinet housing so that each drawer can be individually drawn out of the cabinet housing to an extended position in which the contents of the drawer are accessible.

The individual sliding drawers in this type of cabinet construction are relatively large and become quite heavy when filled with filed material. The size and weight of these drawers make it difficult to draw them out of the cabinet housing to their extended position. Elaborate suspension mechanisms have been developed in an attempt to make it easier to withdraw these drawers from the cabinet housing but such mechanisms are expensive to build and consume valuable filing space within the cabinet.

Because of the substantial weight of drawers of this type when filled, the entire filing cabinet tends to become unstable when more than a single drawer is in its extended position because the center of gravity of the filing cabinet is moved forward out of the housing. To provide greater stability cabinets of this type are customarily provided with an interlocking system which prevents more than one drawer from being withdrawn from the housing at any one time. Without this interlocking system which adds expense and complexity to the cabinet construction, cabinets of this type can fall forward causing damage to the cabinet and its contents and possible injury to those working in the area.

Utilizing the above described relatively large drawers which customarily occupied an entire tier of prior art filing cabinets usually meant that several files relating to different matters would be placed in the same drawer. This required that either the entire contents of a given drawer had to be searched each time a worker went to the drawer for filed material, or indexing means had to be provided within the drawer to ensure that desired material could be located rapidly. If file material was removed from the drawer, the worker had to take great care to reinsert the material in the proper place.

The relatively large unitary type drawers of the prior art cabinets slid out in a horizontal plane so that it was difficult to conveniently examine filed material without physically removing it from the drawer. This was especially true when the material was filed in one of the upper tier drawers of the cabinet. For this reason it was difficult to work with the filed material while it was still in the drawer. Because of this additional otherwise unnecessary time was required to remove and replace filed material.

The present invention overcomes the above described disadvantages of the prior art filing cabinet construction by mounting a plurality of smaller individually slidable, boxlike containers on each tier of the file cabinet. Each of these containers is mounted so that it can be slid completely out of the cabinet housing; and when fully extended, the container will pivot downward over the forward edge of the tier retaining itself at a predetermined downward slope, so that filed material is easily seen and is easily accessible. The novel arrangement whereby the container is mounted on the tier permits the interior of the container to be completely accessible while holding the container firmly on the shelf to prevent it from becoming dislodged accidentally. This provides a convenient work station and will often avoid the need for removing the container from the cabinet.

Since each of the individual containers utilized in this filing cabinet occupies a relatively small portion of the available filing volume of the tier, materials relating to one or at most several files will be placed in each container. The individual containers can then be marked to make file retrieval rapid and efficient.

Because the containers utilized in this construction are smaller and lighter than prior art file drawers, a far simpler and less expensive mounting means can be utilized which provides more usable filing space since the suspension and interlock systems which consumed large amounts of space in prior art cabinets are eliminated. This inventive mounting means permits the individual containers to be removed from the shelf so that files can be removed to a remote work area. Since an entire container is removed rather than an individual file, filed materials are more likely to be kept together, and there is less chance of misplacing or losing files. When the entire container is returned to the cabinet, there is little likelihood of the returned materials being misfiled.

Summary of the Invention

A cabinet construction includes a housing, at least one shelf mounted within the housing and guide means mounted on the shelf. At least one container which is to be mounted on the shelf includes two opposed longitudinal side walls and a bottom wall having a longitudinal channel configured to fit over the guide means and extending in a direction which is substantially parallel to the side walls. Mounting means are disposed adjacent to the channel and are arranged so that the mounting means cooperates with the guide means to detachably mount the container on the shelf.

DESCRIPTION OF THE DRAWINGS

FIG. 2(*b*) is a sectional view of FIG. 1 taken along the plane 2*b*—2*b*.

DESCRIPTION OF INVENTION

Figure 1:
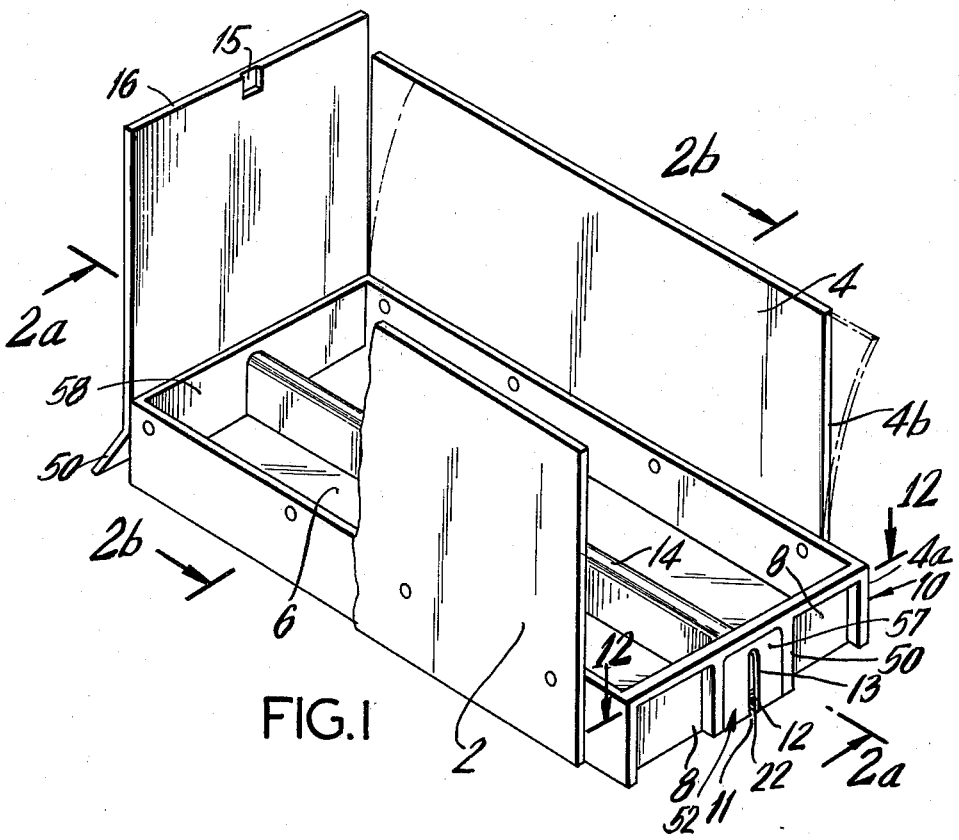
FIG. 1 is a partially cut away perspective view of the container used in the file cabinet construction of this invention.
Figure 2A:
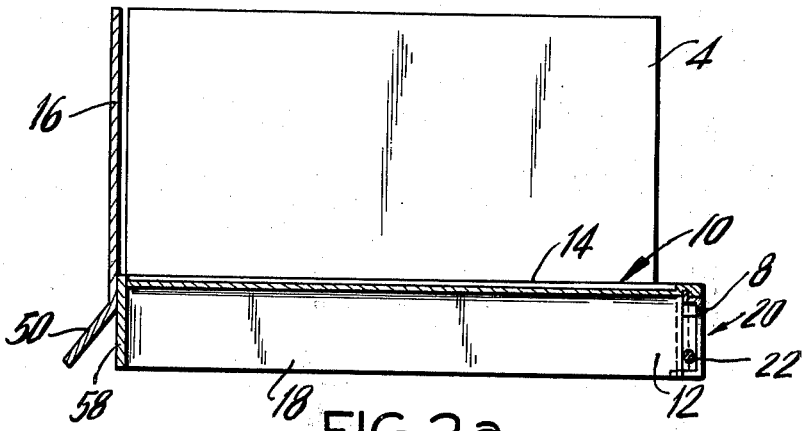
FIG. 2 (*a*) is a sectional view of FIG. 1 taken along the plane 2*a*—2*a*.
Figure 2B:
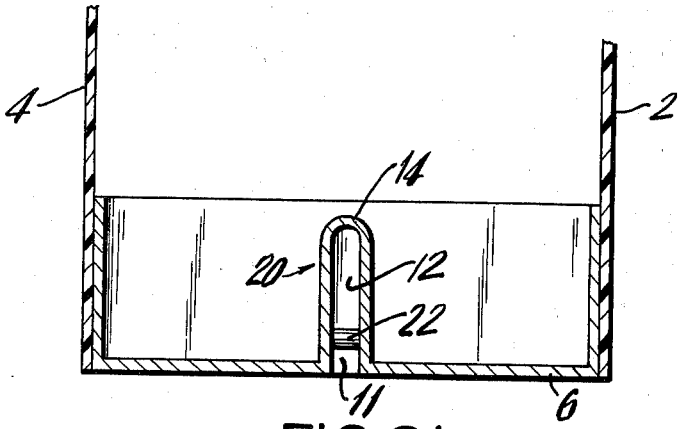

FIG. 1 illustrates one of the containers 10 utilized in the file cabinet construction of the present invention. The container 10 is rectangular in shape and includes parallel longitudinal sides 2 and 4 and a bottom 6. The container 10 may also include a front panel 16 and a back wall 8. The bottom 6 of container 10 includes a slotlike aperture 11 which opens into a longitudinal channel 12. The channel 12 extends from an aperture 13 in the back wall 8 of container 10 to a point adjacent to the front panel 16 of the container. The channel 12 extends upwardly into container 10 to form a raised structure 14. The channel 12 is preferably aligned parallel to and equi-distant from the side walls 2 and 4.

An outwardly extending substantially rectangular frame 50 is formed on the rear wall 8 of the container surrounding aperture 13. An enclosure member 52 shown in detail in FIG. 11 is fitted over the recess formed by frame 50 to define a cavity 60 as best seen in FIG. 12 between the enclosure member 52 and the rear wall within the rectangular frame 50 as best seen in FIG. 12.

Figure 11:
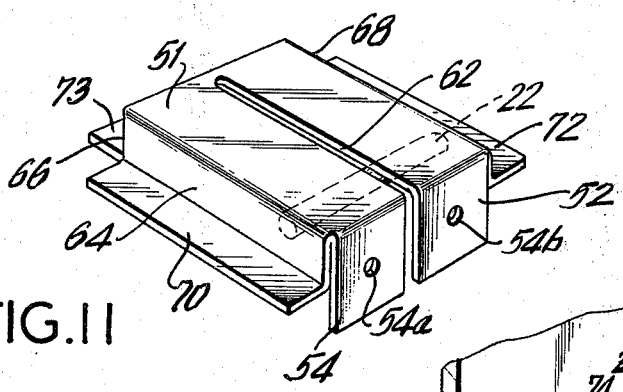
FIG. 11 is a perspective view of an enclosure for the floating pin which forms a part of container shown in FIG. 1.
Figure 12:
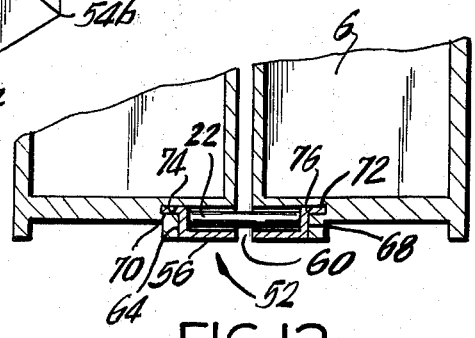
FIG. 12 is a sectional view taken along the plane 12—12 in FIG. 1.

As seen in FIG. 11 the enclosure member 52 includes a rear wall 51, and top flange 66 and a bottom flange 54 extending substantially perpendicularly to the rear wall. Lateral flanges 64 and 68 extend substantially perpendicularly to rear wall 51 so that they abut the inner side walls of rectangular frame 50. Additional flanges 70, 72 and 73 extend substantially perpendicularly outward from lateral flanges 64 and 68 and upper flange 66 respectively. Slots 74 and 76 are provided in the side walls of rectangular frame 50 and an additional slot 78 may be provided in the upper wall of rectangular frame 50.

The enclosure member 52 is attached to the rear wall 8 of container 10 by sliding it upward into the recess defined by rectangular frame 50. As it is slid upward flanges 70, 72 and 73 are inserted respectively into slots 74, 76 and 78 in the rectangular frame. The bottom flange 54 is then attached to the bottom 6 of the container 10 to hold the enclosure member securely to the rear wall of the container 10. Screws can be inserted through holes **54*a* and 54*b* and into the bottom 6** of the container to hold the enclosure member in place.

A slot 62 extends through the flange 54 and through a substantial portion of the back 51 of enclosure member 52. The enclosure member must be mounted on the back wall of container 10 so that slot 62 will be aligned with aperture 13 in the rear wall 8 of the container 10 and with slot 11 in the bottom wall 6 of the container.

A cylindrical pin 22 is arranged within the cavity 60. The pin 22 extends transversely to slot 62 and us configured so that it is freely movable along a line defined by slot 62 upward and downward within the cavity 60.

Figure 3:
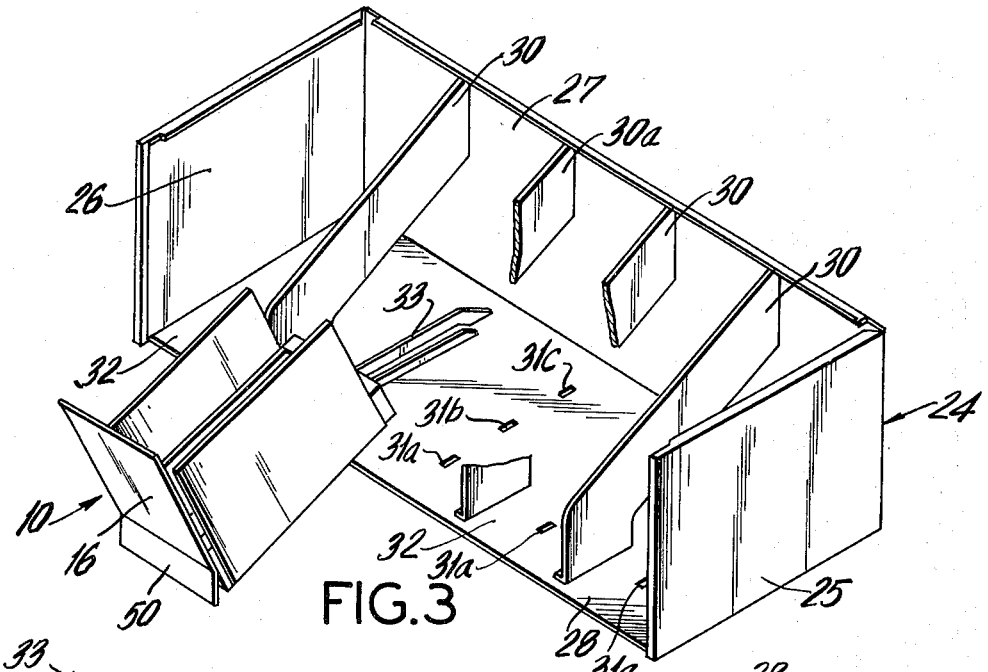
FIG. 3 is a perspective view of the shelf assembly showing one of the containers mounted on the shelf assembly.

FIG. 3 shows the above described container 10 mounted within a shelf assembly 24. The shelf assembly 24 includes side walls 25 and 26, a rear wall 27 and a shelf floor 28. A number of separator panels 30 are attached to the rear wall 27 and to the floor 28 of the shelf assembly to divide the shelf assembly into a number of compartments 32. Three apertures **31(*a*), 31(*b*) and 31(*c*) are formed in the floor 28 in each of compartments 32. Two of the separator panels 30(*a*) and 30(*b*) are shown partially broken away in FIG. 3 so that the mounting apparatus for container 10 can be seen. This mounting apparatus includes a guide rail 33 which is attached to the floor 28 of shelf assembly 24. In practice a similar guide rail 33 would be mounted on the shelf floor 28 of the shelf assembly 24 within each of the compartments 32, but for simplicity only one guide rail 33 is shown in FIG. 3. A container 10 is attached to each of the guide rails 33** in a manner to be described below.

Figure 4:
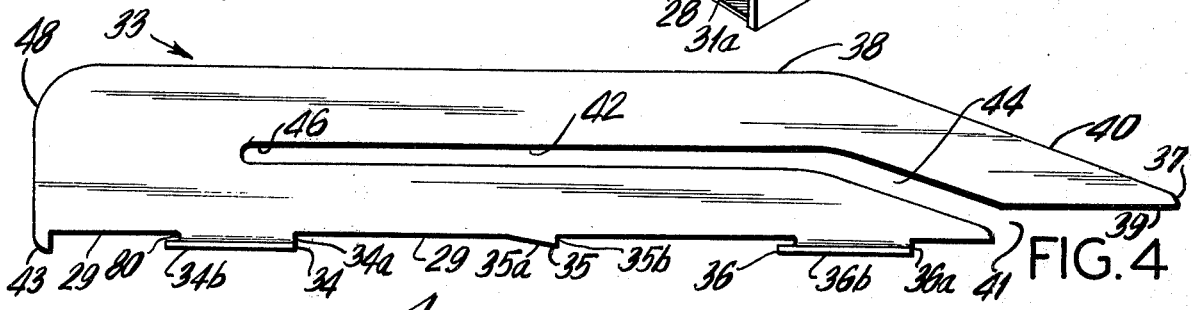
FIG. 4 is a front view of the guide rail used to mount the container on the shelf assembly.

The guide rail 33 is shown in detail in FIG. 4. The undersurface 29 of the rail 33 includes projecting tabs 34, 35, 36 and 43. Tabs 34 and 36 include a first portion, **34*a* and 36*a* extending downwardly from the rail 33 and a second longer portion, 34*b* and 36*b*, which extends substantially perpendicularly to the rail 33. Slots 80 and 82 extend respectively into portions 34*a* and 36*a* of the tabs 34 and 36. The tab 35 extends downward from the rail member 33 and includes a sloping surface 35*a* and a surface 35*b* substantially perpendicularly to the bottom surface 29 of rail 33. Tab 35 is shorter than tabs 34 and 36 as can be seen in FIG. 4**.

Rail 33 is mounted on shelf 28 by inserting portions **34*b* and 36*b* of tabs 34 and 36 into shelf apertures 31*a* and 31*c* and sliding the tabs into their respective apertures until portions 34*a* and 36*a* are resting within apertures 31*a* and 31*c* respectively. Guide rail 33 is then moved forward on shelf 28 so that the shelf extends into slots 80 and 82 and the projecting portion 35*b* of tab 35 snaps into aperture 31*b*. The combination of slots 80 and 82 and tab 35 prevent the rail from moving forward or backward on shelf 28 while the perpendicularly extending portions of tabs 34 and 36 which are in contact with the underside of shelf 28 cooperate with tab 35 to maintain the rail 33 substantially perpendicular to the surface of the shelf 28. The slots 31*a*, 31*b* and 31*c* are aligned so that each of the rails 33 is substantially parallel to the side walls 25 and 26 of the shelf assembly when attached to shelf floor 28. The additional tab 43 extends downward from the bottom surface 29 of the rail at a point where the rail 33 extends outward beyond the forward edge of the shelf 28 so that tab 43 does not interfere with the mounting of the rail. The function of this tab 43** will be discussed below.

The guide rail 33 includes an upper surface 38 which is substantially parallel to shelf assembly floor 28 when the guide rail is mounted. Surface 40 of the guide rail forms an obtuse angle with upper surface 38 at the rear portion of the guide rail and slopes downwardly toward the floor 28 of the shelf assembly. A third surface 39 connects with surface 40 at point 37 of the guide rail 33 and extends forward substantially parallel with the floor 28 of the shelf assembly when the rail is mounted. Surface 39 is spaced from the shelf floor 28 to provide a passage 41 extending forward from point 37 along the shelf assembly floor 28.

A slot 42 in the guide rail 38 extends from the passage 41 to a point adjacent to the forward edge 48 of the guide rail 33. The slot 42 includes a first sloping portion 44, one end of which opens into passage 41 and the other end of which connects to a straight slot portion 46 which is substantially parallel to but spaced from the floor 28 of the shelf assembly when the guide rail 33 is mounted. The rail thickness between slot portion 46 and the bottom surface 29 provides mechanical strength for the rail.

Figure 5:
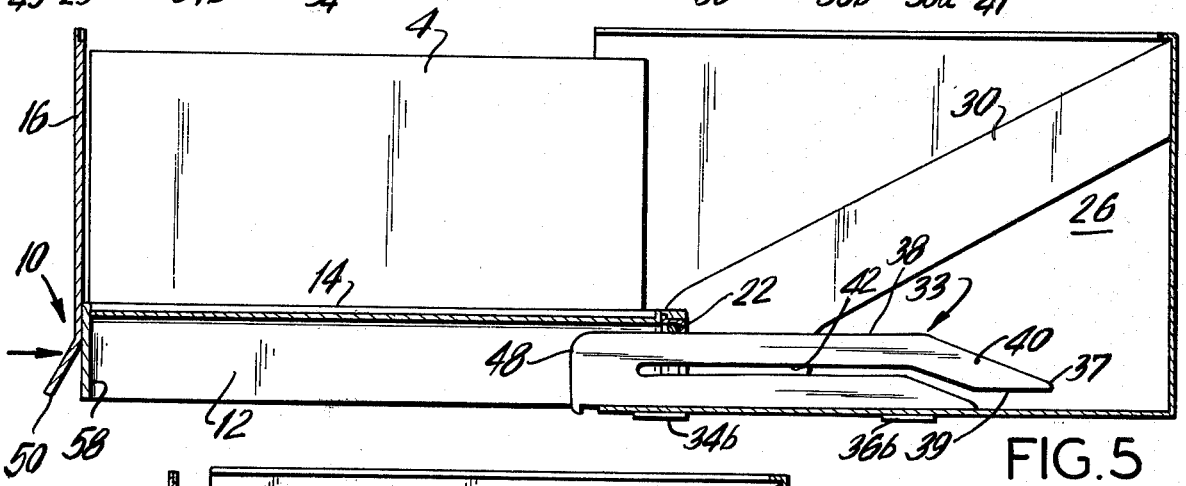
FIG. 5 is a sectional view of the shelf assembly and container showing the container being inserted into the shelf assembly.
Figure 6:
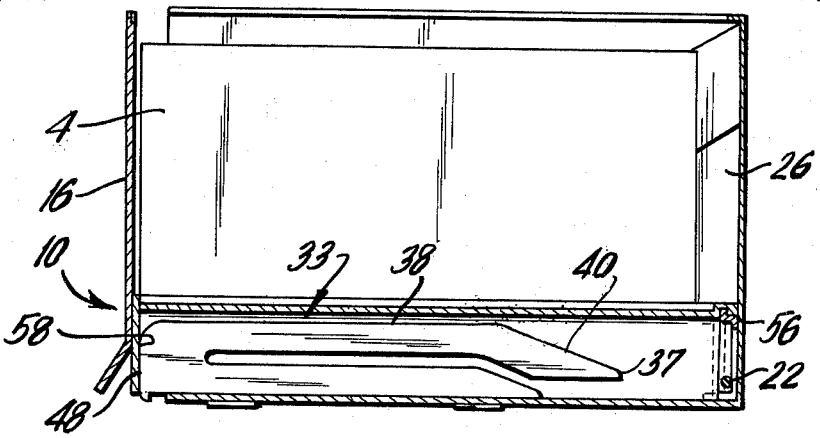
FIG. 6 is a sectional view of the shelf assembly and container showing the container in fully inserted position.
Figure 7:
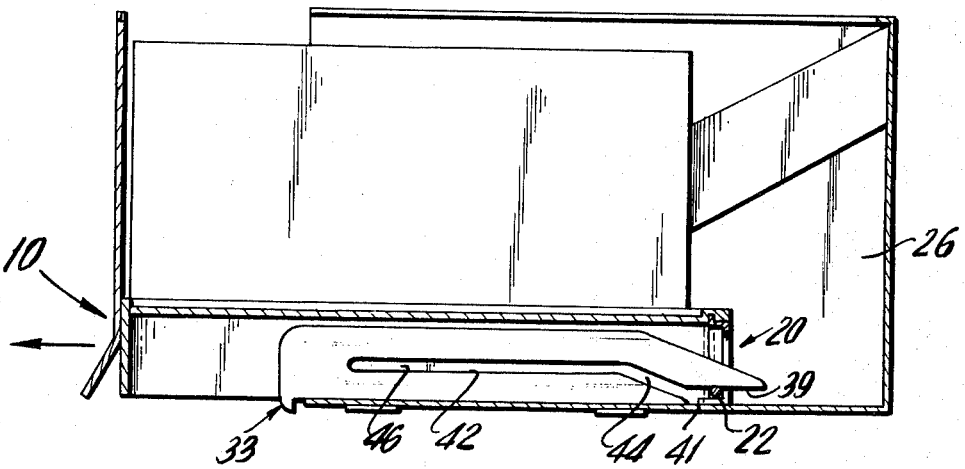
FIG. 7 is a sectional view of the shelf assembly and container showing the container being withdrawn from the shelf assembly.
Figure 8:
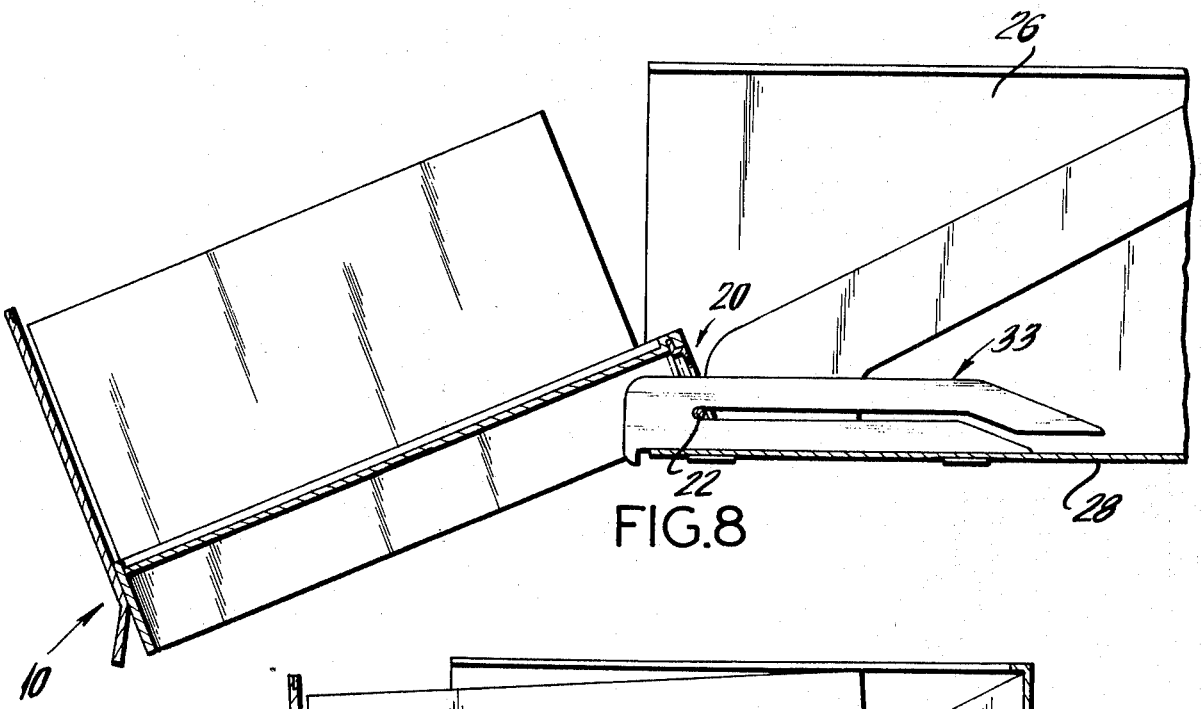
FIG. 8 is a sectional view of the shelf assembly and container showing the container withdrawn as far as possible out of the shelf assembly.
Figure 9:
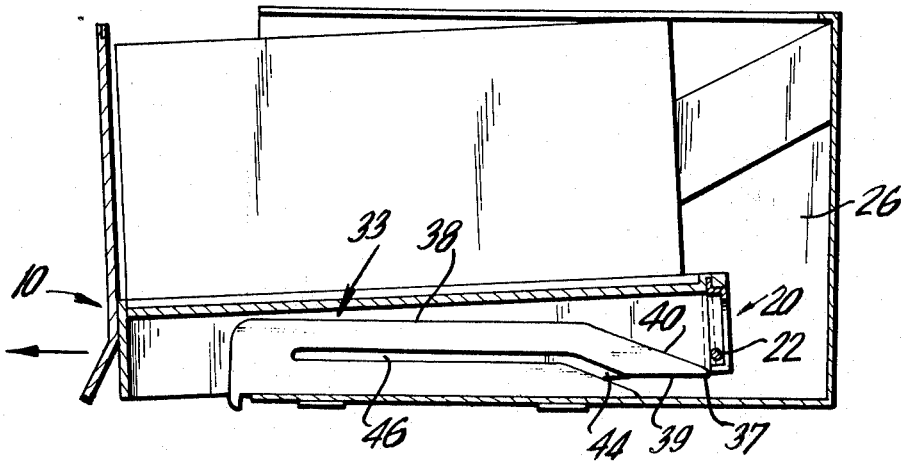
FIG. 9 is a sectional view of the shelf assembly and the container illustrating the manner in which a container may be detached from the shelf assembly.

Referring to FIG. 5, the manner in which container 10 is mounted on the guide rail structure 33 will be described in detail. The container 10 is inserted into the shelf assembly 24 so that the guide rail structure 33 passes through slot 62 and aperture 13 into the channel 12. Pin 22, which extends across channel 12 transverse to slot 62 is moved upward within cavity 60 by the forward end 48 of the guide rail 33, as the guide rail 33 passes through slot 62 and aperture 13 into the channel 12. As the container 10 is pushed into the shelf assembly 24, the pin 22 is near the top of cavity 60 and moves along the top edge 38 of the guide rail structure 33 as shown in FIG. 5. When the rear portion of the container 10 which includes cavity 60 and pin 22 reaches the rear sloping surface 40 of the guide rail structure 33, the pin moves downward along surface 40 within cavity 60 due to the force of gravity. When the container 10 has moved past the inner end 37 of the guide rail 33 and is fully within the shelf assembly 24, the pin 22 has dropped to the bottom of cavity 60 as shown in FIG. 6. In this position the front surface of the guide rail structure 48, which is substantially perpendicular to the floor of the shelf, is resting against the forward end 58 of the channel 12. As shown in FIG. 7 as the container 10 is withdrawn from the assembly 24 the pin 22 moves under surface 39 of the guide rail 33 and into passage 41. The pin 22 is then guided upward within the cavity 60 by the sloping portion 44 of the guide slot 42. As the container 10 is pulled further out of shelf assembly 24, the pin 22 moves along the horizontal portion 46 of the guide slot 42. When fully extended as shown in FIG. 8, the center of gravity of container 10 is moved outward beyond the forward edge of the shelf floor 28 causing the container 10 to pivot about the forward edge of the shelf. The pin 22 is held within the guide slot of rail 33 so that the rear of the container 10 is securely attached to the guide rail 33 while the container is retained in a predetermined sloping position. The angle of slope of the container can be adjusted according to horizontal distance between the forward end of slot 42 and the forward edge of shelf 28. Since the fully extended container 10 slopes downward from the horizontal line defined by the shelf floor 28, the contents of the container become accessible even when the shelf floor 28 is at a great vertical height.

When it is desirable to remove the container 10 from the shelf assembly 24, the container 10 is reinserted into the shelf assembly 24 to a point where the pin 22 is beyond the point 37 where surfaces 39 and 40 of the guide structure 33 meet. During reinsertion the pin 22 moves along the horizontal portion 46 of the slot 42 and the container 10 pivots about the forward edge of the shelf assembly so that the bottom of the container 10 is again brought into a horizontal orientation against the floor 28 of the shelf assembly. As the container 10 is further inserted into the shelf assembly, the pin 22 moves down the sloping portion 44 of the guide slot 42 and then through the passage 41 beneath guide rail surface 39. When the pin 22 is beyond point 37, the forward edge of the container 10 which extends beyond the forward edge of shelf 28 is tilted downward so that the container 10 pivots on the forward edge of the shelf floor 28 causing the rear of the container 10 which includes cavity 60 and the pin 22 to move upward above point 37 on the guide rail structure 33. If the container 10 is then pulled forward and outward from the shelf assembly 24, the pin 22 will ride upward along the rear sloping surface 40 of the guide rail 33 and then along the horizontal surface 38 of the guide rail 33. In this way the pin 22 is freed from guide slot 42 and the container 10 can be removed from the shelf assembly 24.

Figure 10:
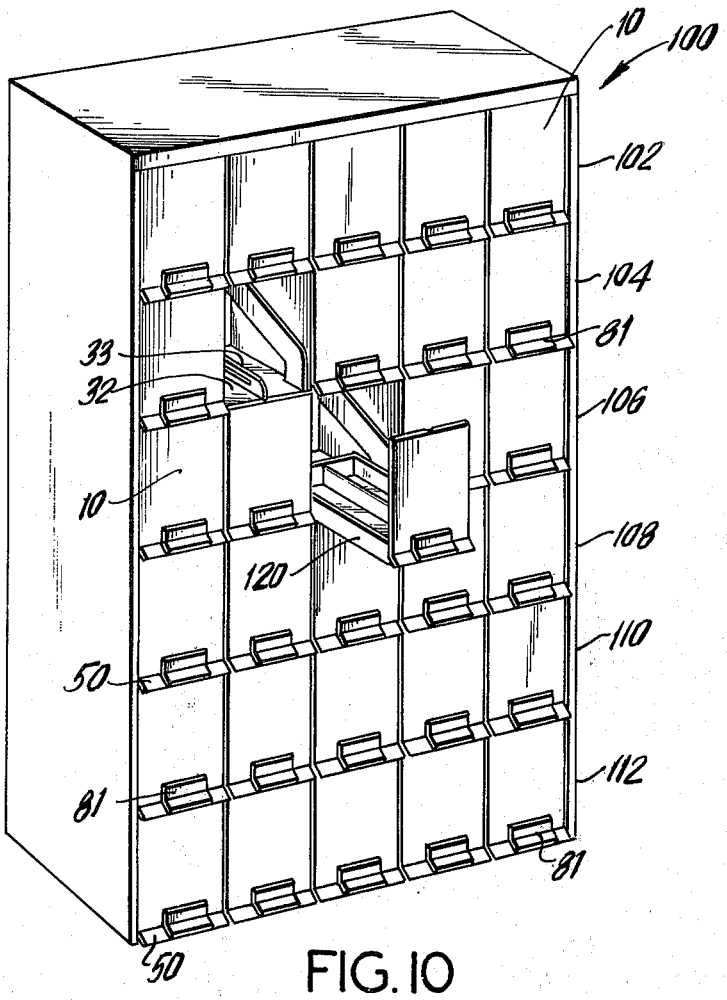
FIG. 10 is a perspective view of a file cabinet including a number of shelf assemblies.

A file cabinet 100 constructed in accordance with this invention is shown in FIG. 10. The cabinet includes a number of vertically arranged tiers 102 through 112 each of which is constructed as described above with reference to the shelf assembly 24 of FIG. 3. For purposes of illustration one of the containers has been removed from tier 104 so that the empty compartment 32 and guide rail 33 can be seen. A container 10 in tier 106 is shown in its fully extended position sloping downward. The configuration shown in FIG. 10 can be varied by employing more or less tiers and by mounting more or less containers on each tier. The size and capacity of the file cabinet can be easily designed to conform to the needs of the user.

The tab 43 shown in FIG. 4 as extending downward from the bottom surface 29 of rail 33 at the forward edge 48 of the rail is used as an indexing means to accurately align the individual containers 10 in a cabinet such as that shown in FIG. 10. As seen in FIG. 1 the inner surface of the top side of the front panel 16 of container 10 includes a recess 15. This recess 15 of a container on a lower tier such as tier 108 mates with the projection 43 extending downward from the rail 33 mounted vertically above that container on tier 106. This indexing arrangement provides proper vertical alignment of the containers 10 in each column.

If desired the front panel 16 of each container 10 can be configured so that it covers substantially the entire opening of the shelf compartment 32 in which it is mounted. In this way the adjacent edges of adjacent containers on each shelf will fit closely together providing the appearance of a unitary front panel covering each tier of the shelf assembly as best seen in FIG. 10.

Handle means such as the forward sloping portion 50 of front panel 16 as seen in FIG. 3 can be provided to facilitate the withdrawal of individual containers 10 from the cabinet assembly. If desired label holder 81 in FIG. 10 can be provided on the front panel 16 of each container 10 so that a label can be affixed to each container for easy identification.

If desired the side walls 2 and 4 of container 10 can include a lower rigid portion such as 4(*a*) in FIG. 1 and an upper flexible portion such as 4(*b*) which is attached to rigid portion 4(*a*). Flexible portion 4(*b*) may be constructed of any suitable flexible material such as plastic or rubber. The provisions of flexible side portion 4(*b*) facilitates the fanning material filed within container 10 making it easier to locate specific documents.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

I claim:

1. A cabinet construction including:

a housing;

at least one shelf mounted within said housing;

guide means mounted on said shelf, said guide means including a rail member having its transverse axis perpendicular to said shelf, and including a longitudinal slot extending into said member from a first end and lying in a plane perpendicular to said shelf;

at least one container, said container including a bottom wall and two opposed longitudinal side walls attached to said bottom wall; said bottom wall of said container including a longitudinally extending channel configured to fit slidably over said guide means; and mounting means attached to said container, said mounting means including an elongated member which is mounted transversely across said channel and arranged to cooperate with said slot in said rail member to detachably mount said container on said shelf.

2. A cabinet construction as claimed in claim 1 in which said container includes a rear wall having an aperture being substantially aligned with said channel; and in which said mounting means includes a bracket, said bracket including a first wall having a slot and flange means connected to the periphery of said first wall, said slot extending through a portion of said flange means; means to attach said bracket to said rear wall so that said slot is aligned with said aperture, said first wall of said bracket being spaced from said rear wall by said flange means to define a cavity, and said elongated member being slidably mounted within said cavity.

3. A cabinet construction as claimed in claim 1 wherein at least the upper portion of said opposed side walls of said container is made of a flexible material.

4. A cabinet construction as claimed in claim 1 wherein said container further includes a front panel and wherein handle means are attached to said front panel.

5. A file cabinet construction including:

a housing having a first and second opposed substantially parallel side walls and a rear wall;

at least one shelf mounted within said housing;

a guide rail having a top surface, a bottom surface and a longitudinal slot extending into said guide rail from a first end;

means for mounting said guide rail on said shelf;

at least one container insertable into said housing, said container including two opposed longitudinal side walls and a bottom wall, said bottom wall including a longitudinal channel configured to fit slidably over said guide rail; and mounting means attached to said container, said mounting means including an elongated member extending transversly across said channel, said member being movable in a plane which is substantially perpendicular to the axis of said channel, and said member being arranged to cooperate with said longitudinal slot in said guide rail to detachably mount said container on said shelf.

6. A file cabinet construction as claimed in claim 5 in which said mounting means includes a plurality of tabs extending from said bottom surface of said guide rail, at least one of a first type of said tabs including a first portion which is coplanar with said rail, a second portion which is substantially perpendicular to said first portion, and a slot extending into said first portion in a direction parallel to the longitudinal axis of said rail, and at least one of a second type of said tabs said second type being substantially coplanar with said guide rail and including a sloping surface extending downward from said bottom surface of said guide rail; and in which said at least one shelf includes a plurality of apertures arranged to cooperate with said tabs so that said guide rail is mounted substantially parallel to said side walls.

7. A file cabinet construction as claimed in claim 5 in which:

said top surface of said guide rail has a first portion which is substantially parallel to said shelf and a second portion which slopes downwardly from said first portion toward said shelf at said first end, and a second surface forming an acute angle with said second portion of said first surface, said second surface being spaced from said shelf to form a passage which connects with said longitudinal slot in said guide rail, said guide rail being mounted on said shelf substantially parallel to said opposed side walls of said housing with said first end of said guide rail being adjacent to said rear wall of said housing; and said elongated member being mounted so that said member moves through said passage and into said slot as said container is withdrawn from said housing.

8. A file cabinet construction as claimed in claim 7 in which said guide rail includes a longitudinal slot having a first portion sloping upwardly from said passage and a second portion which connects with said first portion and extends substantially parallel to said shelf, said second portion terminating at a point adjacent to the edge of said shelf spaced from said rear housing wall; and in which the center of gravity of said container will be beyond said shelf when said elongated member reaches said point in said longitudinal slot of said guide rail causing said container to pivot about said slidable member and said shelf edge when said container is fully withdrawn from said housing.

9. A cabinet construction including:

a housing having opposed substantially parallel side walls and a rear wall;

a number of shelves mounted within said housing in superimposed relation;

a number of guide rails, each of which includes a longitudinal slot, said longitudinal slot extending into said guide rail from a first end;

said guide rails being mounted on each of said shelves so that each of said guide rails is arranged substantially parallel to said opposed side walls of said housing with said first end adjacent to said back wall of said housing;

a number of containers, each of said containers including first and second opposed side walls and a bottom wall, said bottom wall having a longitudinal channel configurated to fit over said guide rail, and mounting means attached to each of said containers said mounting means including an elongated member extending transversly across said channel said elongated member being movable in a plane which is substantially perpendicular to the axis of said channel and said member being arranged to fit slidably into said slot in one of said guide rails when said container is withdrawn from said housing to detachably mount said container on said guide rail.

10. A cabinet construction as claimed in claim 9 in which a plurality of sheetlike members are mounted on each of said shelves so that said sheetlike members are substantially parallel to said opposed side walls of said housing to form a plurality of compartments along each of said shelves, one of said guide rails being mounted in each of said compartments and each of said containers being configured to fit within one of said compartments.

11. A cabinet construction as claimed in claim 10 in which each of said containers includes a rectangular front panel, said front panel having a height substantially equal to the distance between two of said overlapping shelves and a width which is substantially equal to the width of said compartment so that adjacent ones of said front panels abut to form a substantially continuous surface across the front of each of said shelves.

12. A cabinet construction as claimed in claim 11 in which handle means are attached to each of said front panels.

13. A cabinet construction as claimed in claim 9 in which at least one of said side walls of at least some of said containers includes a bottom portion adjacent to said bottom wall of said container and a top portion spaced from said bottom wall of said container and in which said top portion is composed of a flexible material.

14. In combination, a generally horizontal shelf extending between front and rear limits a drawer enterable upon said shelf via the front limit and substantially fully and slidably accommodated in the space between said limits, said drawer having a downwardly open elongate bottom channel aligned in the longitudinal direction of drawer entry and withdrawal from said shelf, an upstanding elongate guide plate carried by said shelf and positioned for guiding coaction with said channel in the course of longitudinal drawer movement, said guide plate being characterized by an elongate generally horizontal slot open only near the rear limit of drawer insertion upon said shelf, and means including a transversely extending member carried by a lower-rear portion of said drawer and extending across said channel and enterable in said slot only for a substantially fully closed condition of said drawer, the forward end of the slot terminating within the body of said plate at a forward location so offset upwardly and rearwardly of said forward limit in relation to the effective vertical offset of said transversely extending member from the drawer bottom that, once engaged in said slot and for a withdrawal of said drawer, said transversely extending member will limit full withdrawal while also retaining a downwardly inclined orientation of said drawer, said orientation being further stabilized by drawer-bottom engagement with the front limit of said shelf.

15. In combination, a generally horizontal shelf having spaced lateral edges and extending longitudinally between front and rear limiting edges, a generally rectangularly prismatic box enterable upon said shelf via the front limiting edge, the bottom of said box including a downwardly open elongate guide channel along the front-to-back center line of said bottom, a locking pin at the rear end of said box and extending transversely of the alignment of said channel, and a longitudinally extending upstanding guide plate secured to said shelf between said lateral edges, said guide plate having an elongate slot having a rearwardly open end in register with the elevation of said pin with respect to said box that, upon withdrawal of said box in the condition of pin-and-slot engagement, said pin will limit full withdrawal while also retaining a downwardly inclined orientation of said box, said orientation being further stabilized by box-bottom engagement with the front edge of said shelf.

16. The combination of claim 15 in which said pin is vertically movably guided at the rear end of said box, the limits of guided movement being a lower elevation in registry with the open end of the box slot when the box is in the shelf and an upper elevation at least as high above the box bottom as is the maximum elevation of the guide plate above the shelf.

17. The combination of claim 15, wherein said guide plate is one of a plurality, at spacings which are substantially the lateral-width dimension of said box, whereby said box may be one of a plurality of like boxes similarly accommodated by said shelf, in side-by-side and independently accessible array.

18. The combination of claim 15, in which said shelf and guide plate are separate parts having coactive formations to lock the same in assembled relation.

19. A cabinet construction including a housing;

at least one shelf mounted within said housing;

guide means mounted on said shelf;

at least one container, said container including a bottom wall, two opposed longitudinal side walls attached to said bottom wall and a rear wall; said bottom wall of said container including a longitudinally extending channel configured to fit slidably over said guide means and said rear wall having an aperture, said aperture being substantially aligned with said channel;

mounting means attached to said container, said mounting means including an elongated member which is mounted transversely across said channel and arranged to cooperate with said guide means to detachably mount said container on said shelf; said mounting means further including a bracket, said bracket including a first wall having a slot and flange means connected to the periphery of said first wall, said slot extending through a portion of said flange means, means to attach said bracket to said rear wall so that said slot is aligned with said aperture, said first wall of said bracket being spaced from said rear wall by said flange means to define a cavity and said elongated member being slidably mounted within said cavity.

* * * * *